US005884453A

United States Patent [19]

Ramsey et al.

[11] Patent Number: 5,884,453

[45] Date of Patent: Mar. 23, 1999

[54] LOW-NOISE FILM UNWRAPPING AND DEVICE

[75] Inventors: David B. Ramsey, Angleton; Robert G. Vidaurri, Lake Jackson; Brad A. Cobler, Lake Jackson; Thomas Oswald, Lake Jackson, all of Tex.

[73] Assignee: The Dow Chemical Company, Midland, Mich.

[21] Appl. No.: 892,559

[22] Filed: Jul. 14, 1997

Related U.S. Application Data

[63] Continuation of Ser. No. 443,950, May 18, 1995, abandoned.

[51] Int. Cl.[6] ..... B65B 53/00

[52] U.S. Cl. ..... 53/441; 53/556; 53/587; 53/389.4

[58] Field of Search ..... 53/64, 137.2, 389.4, 53/419, 441, 556, 587; 242/563, 563.1, 564

[56] References Cited

U.S. PATENT DOCUMENTS

| | | | |
|---|---|---|---|
| 3,092,343 | 6/1963 | Beerli | 242/564.4 X |
| 3,467,331 | 9/1969 | Pepmeier | 242/55 |
| 3,989,201 | 11/1976 | Cottrell | 242/55 |
| 4,418,510 | 12/1983 | Lancaster | 53/441 X |
| 4,579,292 | 4/1986 | Weber et al. | 242/564.4 |
| 4,580,738 | 4/1986 | Scheer | 242/564.4 X |
| 4,628,667 | 12/1986 | Humphrey et al. | 53/587 X |
| 4,699,816 | 10/1987 | Galli | 428/40 |
| 4,831,812 | 5/1989 | Martin Cocher et al. | 53/441 X |
| 4,862,678 | 9/1989 | Humphrey | 53/587 X |
| 4,884,385 | 12/1989 | Mushinski et al. | 53/441 X |
| 5,273,809 | 12/1993 | Simmons | 53/441 X |
| 5,460,863 | 10/1995 | Kessel et al. | 428/40 |

FOREIGN PATENT DOCUMENTS

| | | | |
|---|---|---|---|
| 94/01901 | 10/1994 | European Pat. Off. | 53/556 |
| 28 24 433 | 12/1979 | Germany . | |
| 38 31 944 A1 | 4/1990 | Germany . | |
| 1136557 | 12/1968 | United Kingdom . | |

OTHER PUBLICATIONS

JP 05 116257 A (Asahi Chem Ind Co Ltd), 14 May 1993, see abstract.

*Primary Examiner*—Linda Johnson

[57] ABSTRACT

A method and device for unwrapping self-adhering films at reduced noise levels are disclosed. The method and device include means to maintain a sufficiently high unwrapping take-off angle during the unwrapping and dispensing or unwinding of film rollstock. Suitable means provide for substantial acceleration and adjustment of the rollstock rotational speed relative to the speed of the first power driven member of an unwrapping apparatus, or the use of one or more carefully positioned deflector members. The method and device is particularly useful in unwrapping and dispensing operations of high cling stretch wrap films involving the use of turntable-style power driven equipment as well as in unwrapping and unwinding operations of pressure-sensitive adhesive tapes.

8 Claims, 8 Drawing Sheets

LOW-NOISE FILM UNWRAPPING AND DEVICE

CROSS REFERENCE TO RELATED APPLICATIONS

This application is a Rule 1.62 continuation application of application Ser. No. 08/443,950, filed May 18, 1995, now abandoned, the disclosure of which is incorporated herein, in its entirety, by reference.

FIELD OF THE INVENTION

This invention is related to the unwrapping of self-adhering film without incurring high noise levels, i.e., levels >90 decibels. The invention is particularly related to a method and a device for maintaining reduced noise levels while unwrapping high cling stretch wrap films.

BACKGROUND OF THE INVENTION

Stretch cling films are self-adhering films that are used to wrap, fasten and/or protect a variety of items during shipping including palletized goods and new vehicles. Typical stretch-cling film consists of polyethylene impregnated with a low molecular weight tackifier, such as, for example, polyisobutylene. Unwrapping of self-adhering film is either performed manually with hand-held devices or with the use of powered turntable-type wrapping machines or powered unwinding equipment. Unfortunately, regardless of the use or the form of application, high decibel noise is typically generated when self adhering film is unwrapped. In fact, unwrapping noise generally increases as the cling level of the film increases, and commercial stretch-cling wrapping films are particularly notorious for excessive noise generation. For example, unwrapping of commercially supplied stretch-cling films with powered turntable-type wrapping machines typically generates continuous noise in excess of about 90 decibels which exceeds the OSHA standard 1910.95 for permissible workplace noise levels.

The noise associated with unwrapping stretch cling films correlates with the unwrapping take-off angle of the film. In commercial stretch wrapping machinery, when adhesion or cling performance is relatively high, the unwrapping take-off angle of the film will be relatively low during continuous unwrapping operations. For example, for a stretch wrap film having about 140 grams of cling at 200 percent elongation, the unwrapping take-off angle of such film will typically be in the range of about 30 to about 60 degrees and especially less than about 75 degrees.

There are several known approaches for mitigating the high noise levels associated with unwrapping self-adhering films. Known approaches include employing lower tackifier levels or utilizing a generally less effective tackifier such as, for example, a film having cling layers consisting of an ethylene methacrylate (EMA) copolymer having a relatively low methacrylate content or an amorphous polyolefin (APO). Another known approach for reducing high noise levels involves utilizing one-sided cling films rather than two-sided cling films. Still another known approach involves maintaining lower ambient temperatures (air conditioning) at unwrapping facilities which reduces noise by reducing the effective migration of tackifying material to the surface of the film. Another known approach involves utilizing "inherent" cling films characterized as having reduced n-hexane extractables (or higher polymer densities) or less than optimum surface smoothness rather than utilizing inherent films having higher extractable levels, lower densities and/or smoother film surfaces. However, regardless of which film variation is pursued to control unwrapping noise generation, invariably, significant noise reductions are only achieved when the cling performance level of the resultant film is substantially compromised, even to the point of rendering the film only marginally effective as a cling film. Thus, in the prior art, undesirable unwrapping noise has been generally regarded as a necessary trade-off for high effective cling performance.

Whereas attempts to abate unwrapping noise have focused on film modifications, little attention has been given to unwrapping machinery modifications as an approach to abate excessive unwrapping noise. Known unwrapping machinery modifications include rollstock speed control, take-off angle variations and the use of deflectors. However, such machinery modifications pertain to pre-stretching or tensioning of films and generally do not pertain to noise reduction. See, as examples, the disclosures by Redfearn in GB publication 2109722A and Lancaster et al. in U.S. Pat. No. 4,336,679. Known and commercially practiced deflector use and positions, rollstock speed control and take-off angle variations that are allegedly sufficient to achieve desired tensioning levels, are insufficient to effectuate substantial noise reduction during unwrapping operations. For example, commercially available pre-stretch unwrapping machinery must be specifically modified to allow the unwrapping of stretch cling films at noise levels at less than about 95 decibels, especially less than about 90 decibels.

The object of the present invention is to solve the long standing problem of self-adhering films generating excessive noise during unwrapping operations. Another object of the present invention is to achieve substantial noise reduction while maintaining high adhesion or cling performance. Still another object of the present invention is to achieve substantial noise reduction when stretch-cling film is unwrapped and dispensed as either pre-stretched or non-stretched wraps. Unlike prior art approaches that compromise adhesion or cling performance, the present objectives are met by a new method and device that do not require alteration of the cling performance of the film.

SUMMARY OF THE INVENTION

We have discovered that the excessive noise associated with unwrapping self-adhering films can be substantially reduced while maintaining high adhesion or cling performance by effectively increasing the unwrapping take-off angle, that is, the angle at which the film leaves a dispensing rollstock as the film is being unwrapped and dispensed or unwound.

One aspect of the present invention is a method for unwrapping self-adhering films at reduced unwrapping noise levels which comprises (a) providing a rollstock of self-adhering film;

(b) providing an unwrapping apparatus having means to removably engage the rollstock and means to maintain a sufficiently high unwrapping take-off angle to prevent excessive noise generation during the unwrapping and dispensing or unwinding of the rollstock;

(c) engaging the rollstock;

(d) operating the unwrapping apparatus at the sufficiently high unwrapping take-off angle; and (e) unwrapping and dispensing or unwinding the film.

Another aspect of the present invention is a device or a modified apparatus for unwrapping a self-adhering film at reduced noise levels which comprises (a) an unwrapping apparatus having means to removably engage a rollstock of self-adhering film, and (b) means which cooperates with the rollstock to maintain a sufficiently high unwrapping take-off angle to prevent excessive noise generation during the unwrapping and dispensing or unwinding of the rollstock.

DEFINITION OF TERMS

Figure 1:
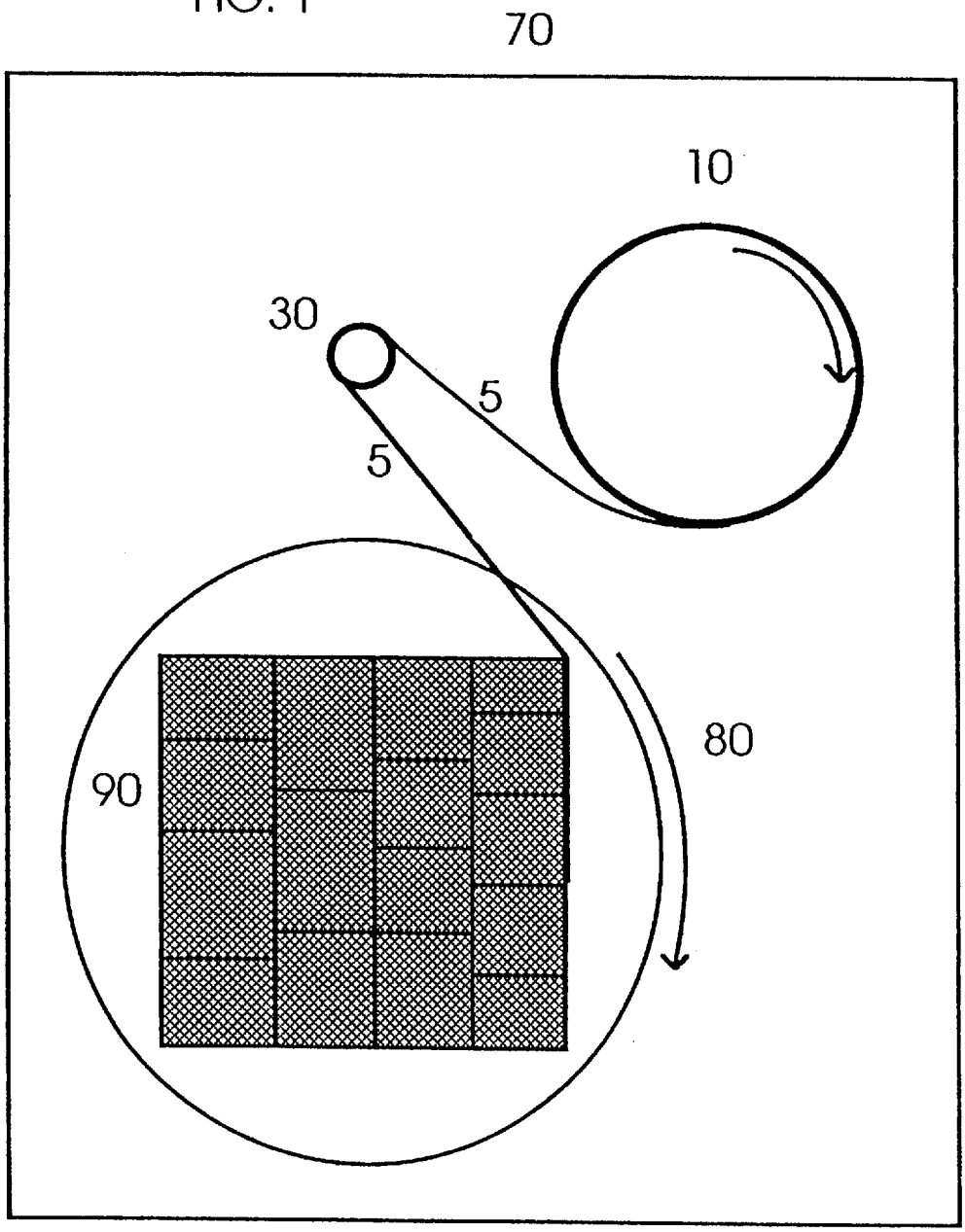
FIG. 1, which is not illustrative of the present invention, is a graphical topview of a rollstock 10 of film 5 being unwrapped and dispensed at an angle of about 0 degrees onto an uptake roller 30 of a stretch wrapping machine 70, the stretch wrapping machine 70 has, downstream of the uptake roller 30, a turntable 80 and a load 90 positioned on the turntable wherein the speed of the uptake roller 30 is directly controlled by the turntable 80.
Figure 2:
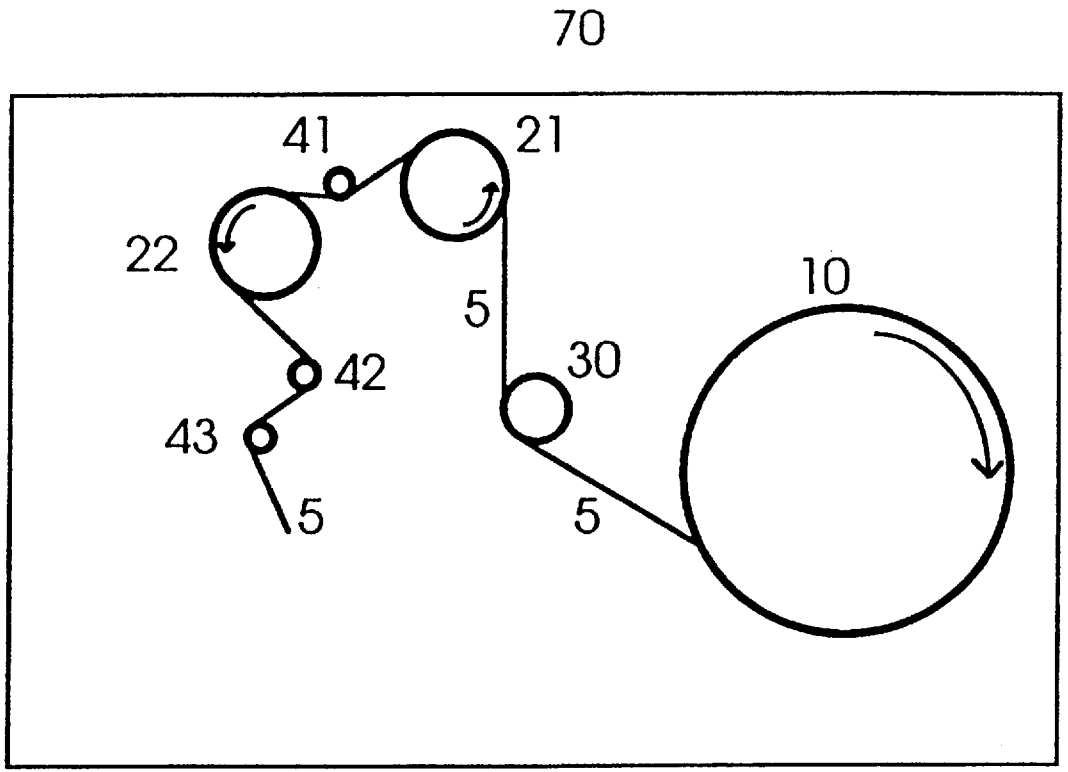
FIG. 2, which is not illustrative of the present invention, is a graphical topview of a rollstock 10 of film 5 being unwrapped and dispensed at an angle of about 60 degrees onto an uptake roller 30 of a stretch wrapping machine 70 having film pre-stretching capabilities, wherein the speed of the uptake roller 30 is controlled by downstream means and the stretch wrapping machine 70 has, downstream of the uptake roller 30, two power driven pre-stretch rollers 21–22, two idler rollers 41–42 and one dancer roller 43.
Figure 3:
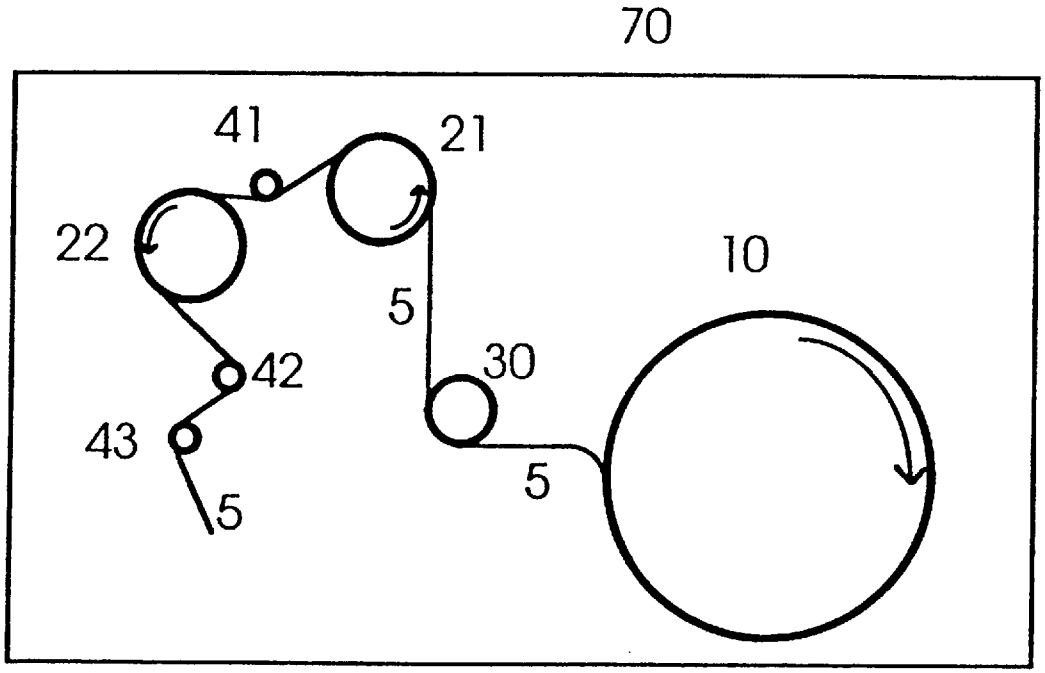
FIG. 3, which is illustrative of the present invention, is a graphical topview of a rollstock 10 of film 5 being unwrapped and dispensed at an angle of about 90 degrees onto an uptake roller 30 of a stretch wrapping machine 70 having film pre-stretching capabilities, wherein the speed of the uptake roller 30 is controlled by downstream means and the stretch wrapping machine 70 has, downstream of the uptake roller 30, two power driven pre-stretch rollers 21–22, two idler rollers 41–42 and one dancer roller 43.
Figure 4:
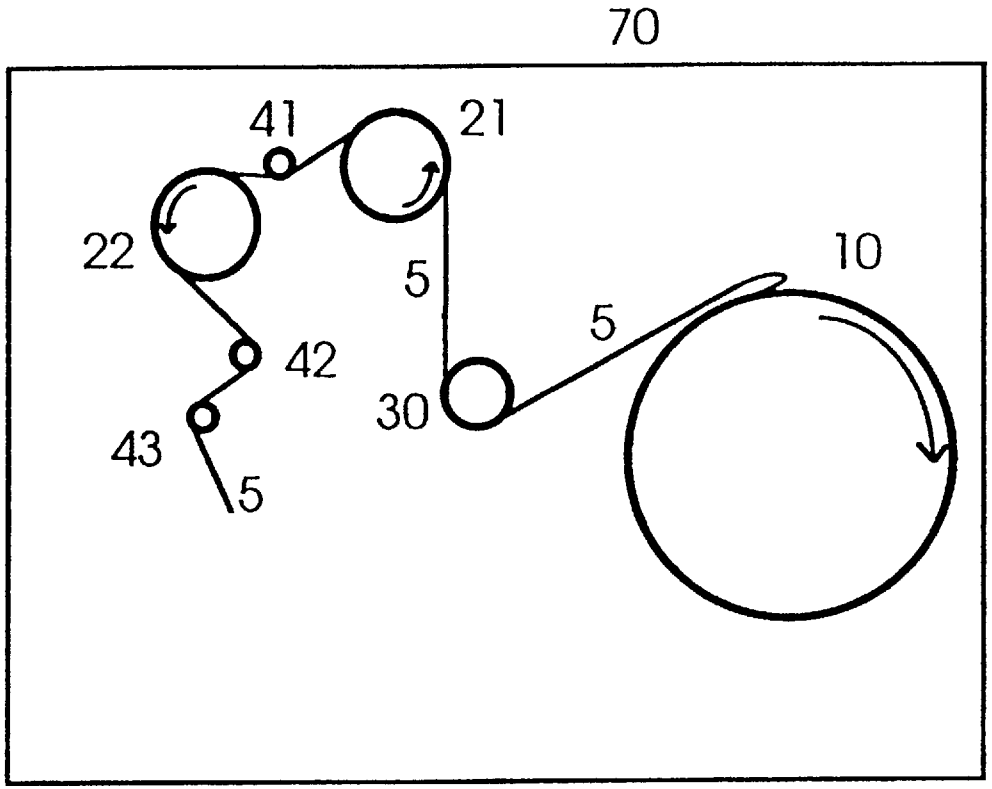
FIG. 4, which is illustrative of the present invention, is a graphical topview of a rollstock 10 of film 5 being unwrapped and dispensed at an angle of about 180 degrees onto an uptake roller 30 of a stretch wrapping machine 70 having film pre-stretching capabilities, wherein the speed of the uptake roller 30 is controlled by downstream means and the stretch wrapping machine 70 has, downstream of the uptake roller 30, two power driven pre-stretch rollers 21–22, two idler rollers 41–42 and one dancer roller 43.

The terms "uptake roller" or "uptake member" as used herein refer to the first roller or structural member of an unwrapping apparatus that a film communicates with after being unwrapping from a rollstock. Where one or more deflector member (defined herein below) is employed, the uptake roller or member is the roller or structural member immediately preceding a first prestretching or tensioning member.

The terms "rollstock" or "dispensing rollstock" as used herein refer to a supply roll or coil of film.

The term "unwrapping apparatus" as used herein refers to hand-held, desk-top and/or powered devices including, but not limited to, turntable style stretch wrapping machines, desk-top tape dispensers and unwinding equipment.

The term "unwrapping take-off angle" as used herein refers to the angle at which the film leaves the dispensing rollstock as the film is being unwrapped and dispensed or unwound with the use of an unwrapping apparatus.

The term "deflector member" as used herein refers to a structural member of an unwrapping apparatus which is interposed between, and oriented parallel to, the rollstock position of the apparatus and the uptake roller or member and provides an unwrapping take-off angle of greater than about 60 degrees. The deflector member is preferably spring-loaded, non-rotating and has a low frictional surface.

The term "first power driven member" as used herein refers to a roller or structural member of an unwrapping apparatus which is positioned downstream of an uptake roller and is power driven (as opposed to free-rotating). The first power driven member can be, for example, the turntable itself or the first power pre-stretch roller of a stretch wrapping machine. If the first power driven member is a pre-stretch roller (as the term is conventionally used in the art of stretch wrapping), it will function to elongate or tension film during unwrapping and dispensing or unwinding operations. The term "power prestretch roller" as used herein can refer to a pre-stretching or tensioning member of an unwrapping apparatus.

The term "idler roller" as used herein and conventionally in the art refers to a free-rotating, non-powered roller situated immediately downstream of a power pre-stretch roller.

The term "dancer roller" as used herein and conventionally in the art refers to a free-rotating, non-powered roller which can be operated mechanically to elongate or tension film. The dancer roller is usually the last roller member of an unwrapping apparatus a film contacts before reaching the load to be wrapped.

DETAILED DISCUSSION OF THE INVENTION

By increasing the unwrapping take-off angle to at least about 75 degrees, preferably at least about 80 degrees, more preferably at least about 85 degrees, especially at least about 90 degrees and most especially at least about 120 degrees, we surprisingly discovered unwrapping noise can be substantially reduced to levels of less than about 100 decibels, preferably less than or equal to about 95 decibels, more preferably less than or equal to about 90 decibels, especially less than or equal to 85 decibels and most especially less than or equal to about 80 g decibels. Generally, the higher the adhesion or cling of the film, the greater the optimum angle at which optimum noise reduction will be achieved.

A preferred embodiment of the present invention is a stretch wrapping device comprising a first and second power pre-stretch roller downstream of an uptake roller, means to removably engage a rollstock of stretch film and means to accelerate and adjust the speed of the rollstock to substantially exceed and then to substantially match the speed of the first power pre-stretch roller during unwrapping and dispensing of the film, wherein the accelerated and adjusted rollstock speed is sufficient to maintain an unwrapping take-off angle of at least about 75 degrees.

Another preferred embodiment of the present invention is a method for unwrapping stretch wrap films at reduced noise levels which comprises providing a rollstock of stretch wrap film, providing a pallet stretch wrapping machine having an uptake roller, a first and a second pre-stretch roller downstream of the uptake roller, means to removably engage the rollstock upstream of the uptake roller and means to accelerate and adjust the speed of the rollstock, engaging the rollstock, operating the stretch wrapping machine, adjusting the speed of the rollstock to substantially exceed and then to substantially match the speed of the first power pre-stretch roller, wherein an unwrapping take-off angle of at least about 75 degrees is maintained, and unwrapping the film.

Figure 5:
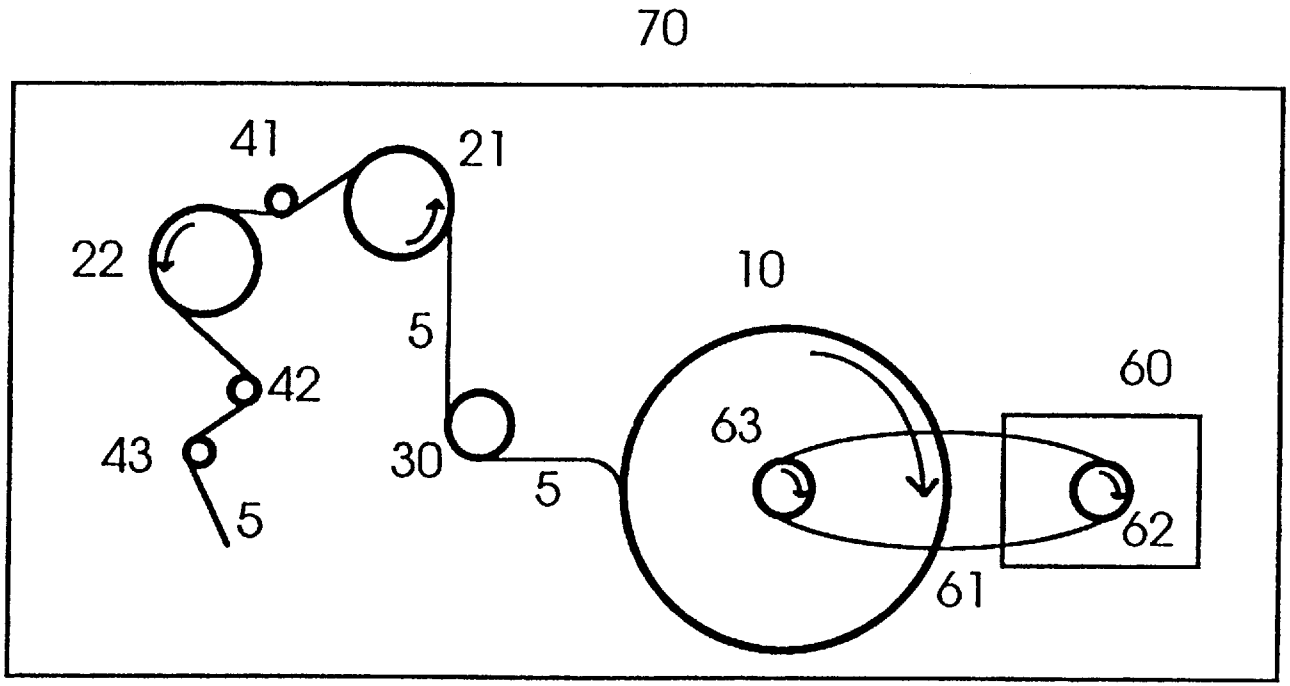
FIG. 5, which is illustrative of the present invention, is a graphical topview of a rollstock 10 of film 5 being unwrapped and dispensed at an angle of about 90 degrees onto an uptake roller 30 of a stretch wrapping machine 70 having film pre-stretching capabilities, wherein the speed of the uptake roller 30 is controlled by downstream means and the stretch wrapping machine 70 has, downstream of the uptake roller 30, two power driven pre-stretch rollers 21–22, two idler rollers 41–42 and one dancer roller 43, and the about 90 degree angle is effectuated by a variable speed motor 60 having a pulley 62 which is engaged to a belt 61, the belt 61 is simultaneously engaged to a second pulley 63 which is affixed, in the embodiment illustrated, to the top of the rollstock 10.

In an especially preferred embodiment, as illustrated, for example, by FIG. 5, the means to accelerate and adjust rollstock speed is accomplished by an assembly comprising a motor, two pulleys and a drive belt, wherein the rollstock speed can be independently accelerated and adjusted from about 0 to about 100 rpms.

Figure 6:
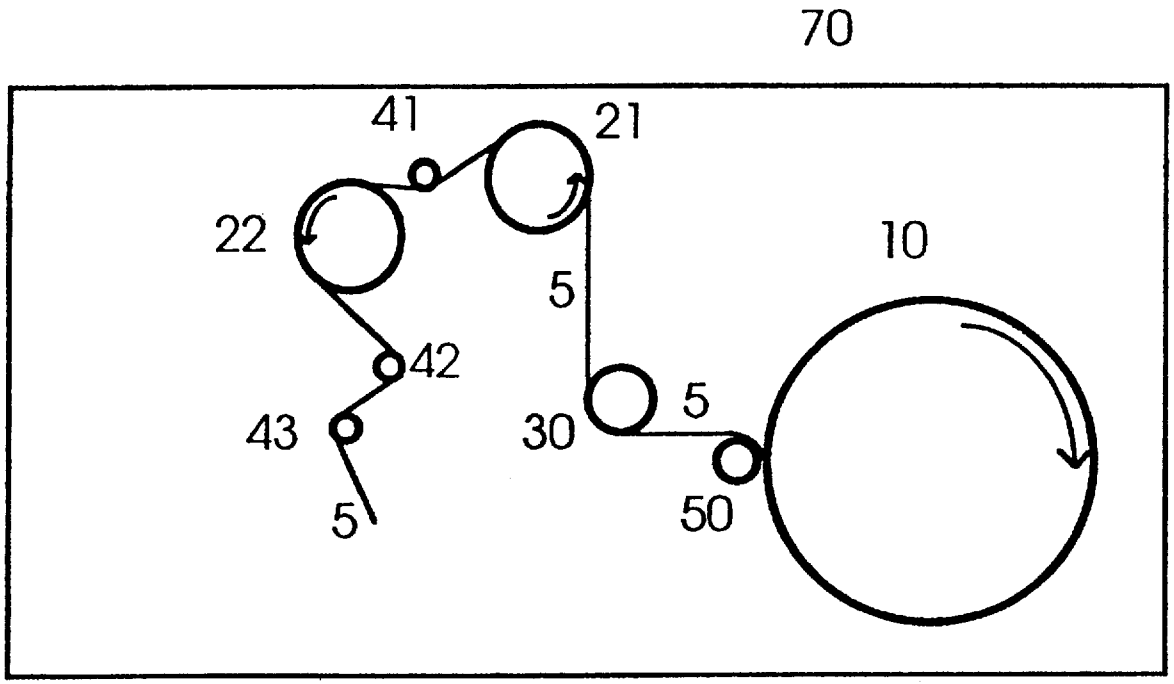
FIG. 6, which is illustrative of the present invention, is a graphical topview of a rollstock 10 of film 5 being unwrapped and dispensed at an angle of about 90 degrees onto the uptake roller 30 of a stretch wrapping machine 70 having film pre-stretching capabilities, wherein the speed of the uptake roller 30 is controlled by downstream means and the stretch wrapping machine 70 has, downstream of the uptake roller 30, two power driven pre-stretch rollers 21–22, two idler rollers 41–42 and one dancer roller 43, and the about 90 degree angle is effectuated by a variable position deflector member 50 positioned proximate to the rollstock 10.

Another embodiment, as illustrated, for example, by FIG. 6, is an unwrapping apparatus having an uptake member, means to removably engage a rollstock of self-adhering film and a variable position deflector member which, when effectively positioned, cooperates with the uptake member and the engaged rollstock to maintain an unwrapping take-off angle of at least about 75 degrees.

Another still embodiment of the present invention is a method for unwrapping self-adhering film at reduced noise levels which comprises providing a rollstock of self-adhering film, providing an unwrapping apparatus having (1) an uptake roller, (2) means to removably engage the rollstock upstream of the uptake roller and (3) a variable position deflector member which cooperates with the uptake member and the rollstock when engaged, engaging the rollstock, operating the unwrapping apparatus, effectively positioning the deflector member to maintain an unwrapping take-off angle of at least about 75 degrees, and unwrapping the film.

Also one or more variable position deflector members and means to accelerate and adjust the speed of the rollstock can be employed in combination for a single device or method. The effective position of the deflector member can also effectuate tensioning of the film as long as it maintains a sufficiently high unwrapping take-off angle. The rollstock speed control means and particularly the use of such means to effectuate a sufficiently high unwrapping take-off angle is completely distinct from conventional unwrapping devices which typically involve free-rotating, non-power driven supply rolls.

In an unwrapping operation, the unwrapping take-off angle is increased by accelerating the rollstock speed to a speed greater than the speed of the first power driven member and thereafter reducing the rollstock speed to substantially match the speed of the first power driven member. The amount of acceleration above the speed of the first power driven member will control the resultant unwrapping take-off angle, i.e., the higher the accelerated speed, the larger the increase in the unwrapping take-off angle. Also, operating at a prolonged time at a moderately higher speed than the first power driven member can accomplish the same angle increase as operating momentarily at a substantially higher speed than the first power driven member. The upper acceleration limit is the onset of rollstock over-wrapping, and if the rollstock speed is not substantially matched to the speed of the first power driven member (in linear meters/minute) after the acceleration, over time in a continuous unwrapping operation, the increased angle will not be maintained and/or undesirable film tensioning will occur.

Where a stretch wrapping apparatus includes a power driven turntable but does not include powered tensioning means (or where such means are not operated during unwrapping) and the required unwrapping take-off angle is effectuated by accelerating and adjusting the rollstock speed, the rollstock speed must be accelerated and adjusted to substantially exceed and then to substantially match the speed of the turntable and load.

Although, preferably, the novel device will be manufactured with the essential features of the present invention incorporated, any known unwrapping apparatus can also be suitably adapted or retrofitted with the essential features of the present invention for use in the novel method or as the novel device. Particularly suitable devices for adaptation are pallet stretch wrapping machines such as, for example, a Lantech SHS Pre-Stretch Wrapper or Mima Accustretch II Power Pre-stretch Wrapper.

Figure 7:
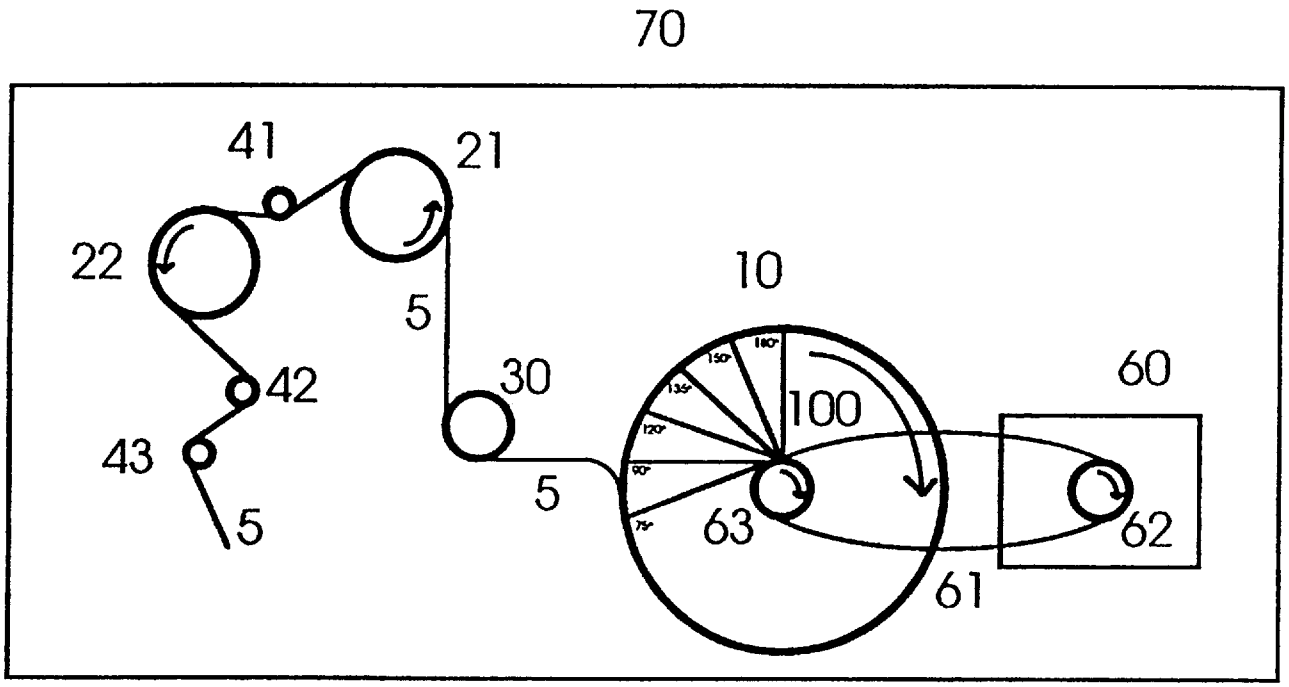
FIG. 7, which is illustrative of the present invention, is a graphical topview equivalent to FIG. 5, except the stretch wrapping machine 70 is equipped with a protractor member 100, positioned tangential to the second pulley 63, to manually measure the unwrapping take-off angle.
Figure 8:
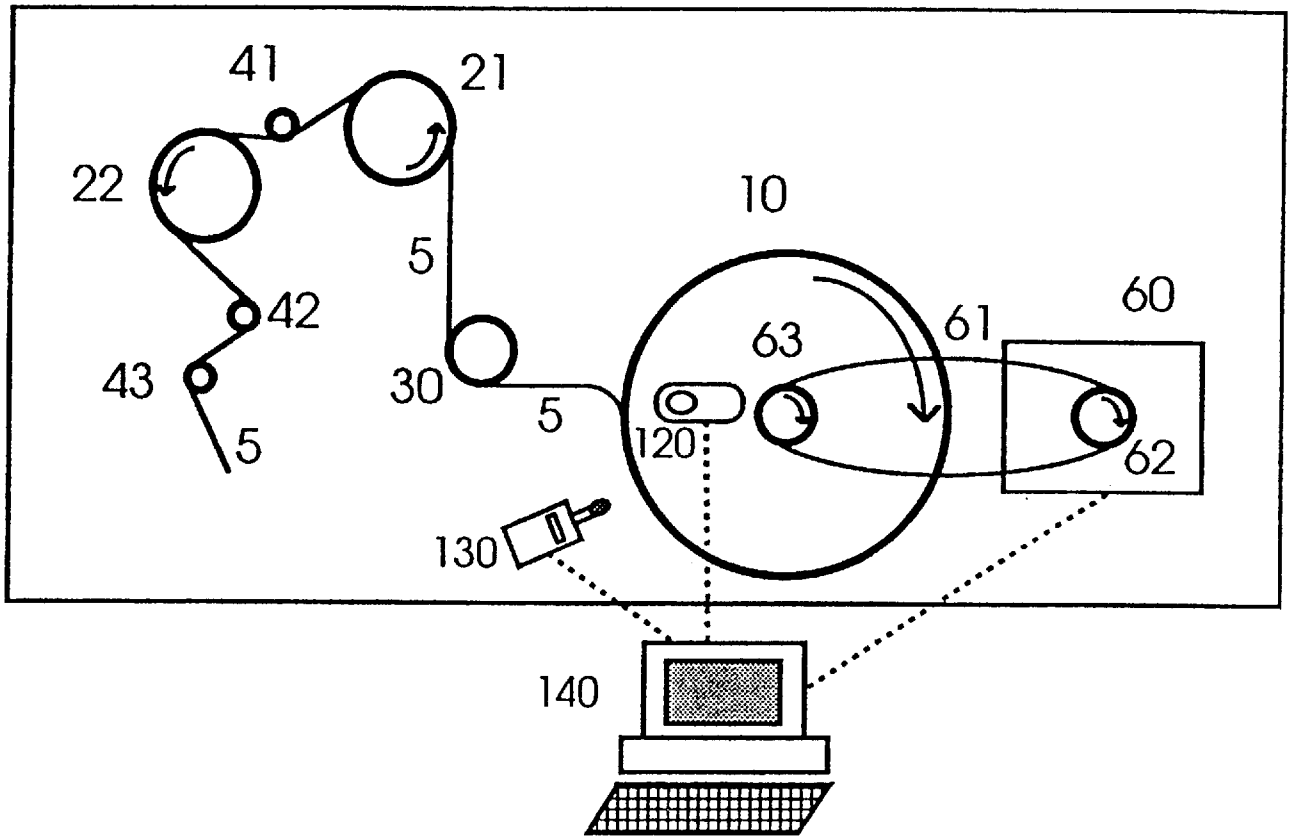
FIG. 8 which is illustrative of the present invention, is a graphical topview equivalent to FIG. 5, except the stretch wrapping machine 70 is equipped with means 120 for automatically sensing the unwrapping take-off angle, a noise detector 130, and a microcomputer 140 which received inputs from the automatic sensing means and the noise detector and delivers output to the motor 60 to control the speed of the rollstock 10 during unwrapping operations.

The unwrapping apparatus can also be fitted with a clock-style protractor (as illustrated in FIG. 7) for manually measuring the unwrapping take-off angle and facilitating manual adjustments of the rollstock speed and/or deflector member positions. Alternately, the unwrapping apparatus can be automated by including means to sense the unwrapping take-off angle and/or noise level detection means and means to provide sufficient automatic rollstock speed adjustments to achieve a predetermined decibel level, such as, for example, a microcomputer connected to received input from the first power driven member, the sensing means and/or the noise level detection means and to deliver output for controlling and adjusting rollstock accelerations and matching speeds.

Any known self-adhering film can be unwrapped and dispensed or unwound by the novel method and device, however particularly suitable films include monolayer or multilayer stretch wrap films including, but not limited to, stretch cling films having one-sided, two-sided, differential and/or inherent cling, and/or prepared with the use of tackifiers (such as, polyisobutylene or turpenes), functional ethylene copolymers (such as ethylene/methacrylate and ethylene vinyl acetate), heterogeneous ethylene/α-olefin interpolymers (such as linear low density ethylene/1-hexene copolymers), homogeneous ethylene/α-olefin interpolymers (such as substantially linear ethylene/1-octene copolymers) or amorphous polyolefins, or combinations thereof. The method and device is also suitable for dispensing or unwinding one-sided and double-sided pressure sensitive adhesive tapes such as, for example, those sold under the brandname Scotch® by 3M Corporation.

The benefits of the present invention include reduced workplace noise during unwrapping operation of self-adhering films and now, to achieve lower noise levels, film formulators do not have to formulate for reduced or marginal adhesion or cling performance.

The following examples illustrate some of the particular embodiments of the present invention, but the following should not be construed to mean the invention is limited to the particular embodiments shown.

EXAMPLES

In the following examples, evaluations are made to determine unwrapping noise characteristics. Various commercial stretch film samples and a labprepared film samples were tested using a Lantech SHS Film Test Power Pre-Stretch Wrapper at a constant turntable speed. All film samples are prestretched at a constant elongation and maintained at that elongation on the wrapped pallet. Noise levels are measured utilizing a Radio Shack Model 2050 Sound Level Meter positioned at about 3.8 cm from the engaged rollstock. Table 1 lists the various film samples employed to evaluate unwrapping noise characteristics.

TABLE 1

| Film Sample | Description |
|---|---|
| A | a non-cling blown film comprising a heterogeneous linear low density ethylene/1-octene copolymer having a 0.920 g/cc density and a 1.0 g/10 min. melt index, the copolymer supplied commercially under the designation DOWLEX ™ 2045A by The Dow Chemical Company. |
| B | a commercially supplied one-sided blown stretch cling film comprising an EMA cling layer. |
| C | a commercially supplied one-sided cast stretch cling film comprising an EMA cling layer, the EMA is supplied commercially under the designation XC-101 by Exxon Chemical Corporation. |
| D | an one-sided cast stretch "inherent" cling film comprising 8 weight percent of a substantially linear ethylene/1-octene copolymer as a cling layer component, the copolymer is supplied commecially under the designation ENGAGE ™ KC 8852 by The Dow Chemical Commpany. |
| E | an one-sided cast stretch "inherent" cling film comprising 10 weight percent of a substantially linear ethylene/1-octene copolymer as a cling layer component, the copolymer is supplied commercially under the designation ENGAGE ™ KC 8852 by The Dow Chemical Company. |
| F | an one-sided cast stretch "inherent" cling film comprising 12 weight percent of a substantially linear ethylene/1-octene copolymer as a cling layer component, the copolymer is supplied commercially under the designation ENGAGE ™ KC 8852 by The Dow Chemical Company. |
| G | a commercially supplied one-sided blown stretch cling film comprising about 1.5 weight percent of polyisobutylene as a cling layer component. |
| H | a commercially supplied one-sided cast stretch cling film comprising an EMA cling layer, the EMA is supplied commercially under the designation XC-102 by Exxon Chemical Corporation. |

To increase the unwrapping take-off angle, the stretch wrapper is adapted with a drive assembly as described in Table 2.

TABLE 2

| |
|---|
| Motor - a Dayton Maxi-Torq ™ motor, Model# 4Z131A, which is a reversible 90 volt permanent magnet DC gear motor capable of 109 rpms, 3.05 Joules of torque and 37.3 Joules/sec of power. |
| Gear Motor Speed Controller - a Dayton motor, Model# 6A191, having a 21–47 Joules/sec range of power, 90 arm. volts and a 15:1 constant torque speed range. |
| Gear Motor Pulley - Phoenix Model# A250-⅝, V-Belt Pulley, 2½ inch (6.35 cm) diameter, designed to fit a ⅝ inch (1.6 cm) shaft. |
| Rollstock Pulley - Phoenix Model# A500-¾, V-Belt Pulley, 5 inch (12.7 cm) diameter, designed to fit a ¾e inch (1.9 cm) shaft. |
| Drive Belt - Gates Hi-Power ® II, Model A26, 9¼ inch (23.5 cm) OD, V-Belt. |

The controller allowed the gear motor speed to be controlled from 0 to about 109 rpms and the gear motor pulley, rollstock pulley and the drive belt together constituted a pulley speed reduction system which, when coupled to the gear motor, allowed the rollstock speed to be controlled from 0 to about 54.5 rpms. Increasing the rollstock speed to substantially approach, match or exceed the speed of the first pre-stretch roller resulted in unwrapping take-off angles greater than about 60 degrees.

Comparative Runs 1–7 and Inventive Examples 8–12

Table 3 illustrates the noise levels for Film Samples A–F with and without the unwrapping take-off angle maintained above about 60 degrees. Comparative Runs 1–6 correspond directly to Film Samples A–F. Comparative Run 7 utilizes Film Sample A. Inventive Examples 8–12 correspond to Film Samples B–F. The films were wrapped at a 200% pre-stretch and a turntable speed of 9 rpm. The tangential angle of the films as they are unwrapped from the supply roll (i.e., the unwrapping take-off angle) is approximately 60 degrees without the use of the above described invention and is increased to 180 degrees when the present invention is employed.

TABLE 3

| Film Sample | Run/Example | Approx. Unwrapping Take-Off Angle (in degrees) | Noise Level (±1 decibels) |
|---|---|---|---|
| A | 1* | 60 | 72 |
| B | 2* | 60 | 109 |
| C | 3* | 60 | 100 |
| D | 4* | 60 | 104 |
| E | 5* | 60 | 103 |
| F | 6* | 60 | 104 |
| A | 7* | 180 | 71 |
| B | 8 | 180 | 72 |
| C | 9 | 180 | 88 |
| D | 10 | 180 | 89 |
| E | 11 | 180 | 88 |
| F | 12 | 180 | 88 |

*Not an example of the present invention; example is only provided as a comparative example.

Film Sample A is not a self-adhering film and does not exhibit the elevated noise levels ordinarily associated with unwrapping with cling film such as, for example, Comparative Runs 2–6. However, Film Sample A (Comparative Runs 1 and 7) conveniently demonstrates that some of the noise generated during unwrapping with the Lantech Stretch Wrapper machine can be attributed to the stretch wrapping apparatus itself, i.e., the baseline of the stretch wrapper is about 71–73 decibels. Comparative Runs 2–6 are various stretch cling films that exhibit excessive noise levels when unwrapped and dispensed with stretch wrap equipment.

As illustrated in Table 3, Comparative Runs 1 and 7 essentially represent an inherently "quiet" films. However, the noise level of Film Sample B, a commercial stretch cling film which is considered one of the noisiest in the industry, is surprisingly reduced more than 33% (Inventive Example 8) by adjusting the rollstock speed to substantially exceed the speed of the first power pre-stretch roller on the Lantech Stretch Wrapper. Adjusting the rollstock speed resulted in the unwrapping take-off angle increasing from about 60 degrees at its undisturbed state to about 180 degrees. Inventive Examples 9–12 also exhibit substantially reduced noise levels utilizing the same method and modified equipment described for Inventive Example 8.

In another evaluation, the speed of a rollstock (Film Sample B having a 8 inch (20.3 cm) roll diameter) is momentarily accelerated relative to the speed of the first power pre-stretch roller and then reduced to substantially match the speed of the first power pre-stretch roller. Film tensioning is maintained at 200% elongation, the turntable speed is 9 rpms, the first power pre-stretch roller speed is 27.8 rpms (12.2 m/minute) and the rollstock speed after acceleration is 19.1 rpms (12 m/minute). Table 4 illustrates the various noise levels measured for Film Sample B as the unwrapping take-off angle is consequently varied by varying the rollstock speed.

TABLE 4

| Example | Unwrapping Take-Off Angle (degrees) | Noise Level (db) |
|---|---|---|
| 13* | 60 | 109 |
| 14* | 75 | 109 |
| 15 | 90 | 72 |
| 16 | 135 | 72 |
| 17 | 180 | 72 |

*Not an example of the present invention; example is only provided as a comparative example.

As illustrated in Table 4, changing the angle of the film as it is unwrapped from the film rollstock and fed onto the uptake roller of the modified Lantech SHS Power Pre-Stretch stretch wrapping machine results in a significant reduction the noise level. The change (increase) in film angle is accomplished by adjusting the rollstock speed substantially approach, match or exceed the speed of the first power pre-stretch roller of the stretch wrapper. For Inventive Examples 15–17, noise levels are reduced more than 33% by increasing the unwrapping take-off angle by means of a gear motor, pulley and drive belt assembly as illustrated in FIG. 7.

Inventive Examples 24–29 and Comparative Runs 18–23

For Inventive Examples 24–29 and Comparative Runs 18–23, Table 5 illustrates the effect of varying the turntable speed and the percent elongation on noise levels with and without affecting the unwrapping take-off angle.

TABLE 5

| Film Sample | Example | Turntable Speed (rpm) | Film Percent Elongation | Approx. Unwrapping Take-Off Angle (in degrees) | Noise Levels w/patent (db) |
|---|---|---|---|---|---|
| G | 18* | 9 | 150 | 60 | 98 |
| G | 19* | 9 | 200 | 60 | 99 |
| G | 20* | 14 | 200 | 60 | 99 |
| H | 21* | 9 | 150 | 60 | 96 |
| H | 22* | 9 | 200 | 60 | 97 |
| H | 23* | 14 | 200 | 60 | 97 |
| G | 24 | 9 | 150 | 90 | 80 |
| G | 25 | 9 | 200 | 90 | 80 |
| G | 26 | 14 | 200 | 90 | 80 |
| H | 27 | 9 | 150 | 90 | 80 |
| H | 28 | 9 | 200 | 90 | 80 |
| H | 29 | 14 | 200 | 90 | 80 |

*Not an example of the present invention; example is only provided as a comparative example.

As Table 5 demonstrates, the effect of both turntable speed and percent elongation (tensioning) on the noise level is negligible without any substantial affect on the unwrapping take-off angle. However, with the practice of the present invention, dramatic reductions (e.g., at least about 10%, usually at least 15% and most usually at least about 25% reductions) can be achieved respecting the noise ordinarily associated with the unwrapping and dispensing or unwinding of stretch cling films. As a great benefit to film users, such reductions are achieved without compromising the cling performance of the film.

What is claimed is:

1. A method for unwinding a rollstock of stretch wrap film at reduced unwinding noise levels which comprises (a) providing a rollstock of stretch wrap film;

(b) providing an unwrapping apparatus having a turntable, means to removably engage the rollstock of stretch wrap film and means to maintain an unwrapping take-off angle of at least about 90 degrees during the unwinding of the rollstock of stretch wrap film;

(c) engaging the rollstock of stretch wrap film with the engaging means;

(d) operating the unwrapping apparatus while maintaining the unwrapping take-off angle at least about 90 degrees; and (e) unwinding the rollstock of stretch wrap film at a turntable speed in the range of from about 9 to about 14 revolutions per minute and at an unwinding noise level of less than or equal to 80 decibels.

2. The method of claim 1, wherein the unwrapping apparatus has at least one first power driven member and the means to maintain the at least about 90 degree unwrapping take-off angle is accomplished with separate means which can accelerate and adjust the rollstock speed to substantially exceed and then to substantially match the speed of the at least one first power driven member during unwinding of the rollstock of stretch wrap film.

3. The method of claim 2, wherein the unwrapping apparatus is a stretch wrapping machine and the separate means is a motor, pulley and drive belt assembly connected to the rollstock which independently controls the rotational speed of the rollstock.

4. The method of claim 1, wherein the stretch wrap film is a stretch cling film.

5. The method of claim 4, wherein the stretch cling film is an one-sided cling stretch film.

6. The method of claim 5, wherein the one-sided cling stretch film comprises a substantially linear ethylene/α-olefin interpolymer.

7. The method of claim 6, wherein the substantially linear ethylene/α-olefin interpolymer is a component of the cling layer.

8. The method of claim 1, wherein the apparatus comprises an uptake member downstream of the means which removably engages the rollstock of stretch wrap film and the means to maintain the at least about 90 degree unwrapping take-off angle is accomplished with at least one variable position deflector member which is effectively positioned proximate to the engaged rollstock of stretch wrap film and cooperates with the uptake member and the engaged rollstock of stretch wrap film to maintain the unwrapping take-off angle.

* * * * *